United States Patent [19]

Doering

[11] Patent Number: 4,877,142

[45] Date of Patent: Oct. 31, 1989

[54] RECTANGULAR BOTTLE FOR MOTOR OIL AND LIKE FLUIDS

[75] Inventor: John P. Doering, Humble, Tex.

[73] Assignee: Texaco, Inc., White Plains, N.Y.

[21] Appl. No.: 203,636

[22] Filed: Jun. 3, 1988

Related U.S. Application Data

[63] Continuation of Ser. No. 53,762, May 26, 1987, abandoned.

[51] Int. Cl.[4] ..... B65D 1/02

[52] U.S. Cl. ..... 215/1 C; 215/10; 206/386

[58] Field of Search ..... 215/1 C, 10, 1 R; D9/375; 206/503, 504, 509

[56] References Cited

U.S. PATENT DOCUMENTS

| | | | |
|---|---|---|---|
| D. 213,766 | 4/1969 | Weckman | D9/409 X |
| D. 246,226 | 11/1977 | Avolio | D9/67 |
| D. 252,671 | 8/1979 | Strand | D9/404 |
| D. 259,766 | 7/1981 | Hartung | D9/370 |
| D. 265,888 | 8/1982 | Epperson | D9/375 |
| D. 271,084 | 10/1983 | Gurolnick | D9/389 |
| D. 273,768 | 5/1984 | Sedam et al. | D9/375 |
| D. 279,455 | 7/1985 | Fleming | D9/389 |
| D. 282,633 | 2/1986 | Beaver et al. | D9/375 |
| D. 282,634 | 2/1986 | Beaver et al. | D9/375 |
| D. 282,635 | 2/1986 | Beaver et al. | D9/376 |
| D. 282,641 | 2/1986 | Beaver et al. | D9/408 |
| D. 287,337 | 12/1986 | Nickel | D9/349 |
| D. 287,338 | 12/1986 | Biesecker | D9/355 |
| D. 289,376 | 4/1987 | Nemits | D9/375 |
| D. 296,667 | 7/1988 | Salter | D9/375 |
| 3,232,495 | 2/1966 | Schneider | 222/210 |
| 3,933,268 | 1/1976 | Buske | 215/10 X |
| 4,573,595 | 3/1986 | Mednis | 215/10 |
| 4,589,560 | 5/1986 | Harris, Jr. | 215/1 C |
| 4,610,366 | 9/1986 | Estes et al. | 215/1 C |

OTHER PUBLICATIONS

Table I Dimensional Comparison from "Plastic Container Presentation" prepared by Sun Refining & Marketing Co. and Boise Graham Co., 9/24/85.

*Primary Examiner*—Sue A. Weaver

*Attorney, Agent, or Firm*—Kurt S. Myers; John R. Kirk, Jr.; Jack H. Park

[57] ABSTRACT

The present invention provides for a new and improved rectangular bottle for motor oil and the like fluids. The rectangular bottle of the present invention is of the type having an offset spout, and is particularly designed to be stacked and shipped on a standard 40 in.×48 in. GMA pallet.

19 Claims, 5 Drawing Sheets

RECTANGULAR BOTTLE FOR MOTOR OIL AND LIKE FLUIDS

This application is a continuation of application Ser. No. 053,762, filed May 26, 1987, now abandonded.

BACKGROUND OF THE INVENTION

The present invention relates generally to bottles for packaging, storing, transporting and distributing various liquids. More particularly, the present invention relates to rectangular bottles constructed of plastic and the like for containing motor oils and other related fluids.

Fluids such as motor oils have, until recently, primarily been packaged in composite fiber (laminated) cylindrical containers closed on each end by a metallic plate. As is evident from ever having used or been around such containers, they suffer from many shortcomings including poor shelf life and individual container integrity (seepage of oil through the composite fiber), difficulty in opening and resealing once opened, and difficulty in pouring the contents without unwanted spillage. Despite these shortcomings, cylindrical composite fiber containers predominated in the marketplace due to the lack of a viable and economical alternative.

More recently, however, cylindrical composite fiber containers are rapidly being replaced by plastic bottles. The use of plastics such as, for example, high density polyethylene, may improve the shelf life and integrity of the individual bottles with comparable manufacturing and packaging costs. Consumers today also tend to prefer a plastic bottle, particularly for motor oils and the like, over the prior composite fiber container.

Plastic motor oil bottles come in a wide variety of shapes and forms including, but not limited to, cylindrical bottles closed on one or both ends with a metallic plate, cylindrical bottles with centrally oriented spouts, cylindrical bottles with offset spouts, rectangular bottles with centrally oriented spouts and rectangular bottles with offset spouts. Generally the bottles with spouts are also provided with screw cap or other closure means for sealing and resealing the bottles once opened.

The cylindrical shape, though, has several practical disadvantages. Cylindrical containers are not very space efficient, that is, there is a significant amount of void space between individual containers when such containers are packaged or otherwise placed side-by-side. This void space can be significantly reduced by the use of a rectangular container. Rectangular containers are also easier to grip and hold in most cases than their cylindrical counterparts.

The plastic rectangular motor oil bottles presently in use, however, suffer form many shortcomings. First and foremost, the great majority of rectangular bottles, particularly the one quart capacity bottles, cannot be effeciently stacked and shipped on a standard 40 in.×48 in. GMA (Grocery Manufacturers Association) pallet. This pallet size is the standard of the grocery industry by which most warehouses, shipping trucks and rail cars are constructed. By utilizing non-standard sized pallets, maximum space utilization for storage and shipping cannot be achieved.

While not designed for the standard pallet, these plastic rectangular bottles may still be stacked on the standard pallets, but the cases in which the bottles are packaged will overhang past the edge of the pallet. By overhanging the cases and, therefore, the bottles, the potential for container damage and breakage is greatly increased. Further, the overhang enlarges the space requirement for the pallet and, therefore, the purpose and advantages of using the standard pallet are defeated. These rectangular bottles can also be stacked without the overhang, but then a significant portion of the pallet surface will not be utilized.

Other disadvantages of many of the rectangular motor oil bottles currently in use include pouring difficulties (premature spillage from content surge, "glug" from poor venting), poor warehouse and shelf life, poor stackability (container integrity, top-load strength) and low shelf-space utilization.

It is, therefore, an object of the present invention to provide a rectangular motor oil bottle designed to be made of plastic and stacked and shipped on a standard 40 in.×48 in. GMA pallet.

It is a further object of the present invention to provide a rectangular motor oil bottle which has comparible or improved warehouse and shelf life and container integrity (top-load strength) as compared with present rectangular motor oil bottles.

It is a still further object of the present invention to provide a rectangular motor oil bottle with a high shelf-space utilization.

It is finally another object of the present invention to provide a rectangular motor oil bottle which improves pourability of the contents from the bottle by lessening the chances for unwanted spillage and reducing content surge from "glug."

SUMMARY OF THE INVENTION

In accordance with the present invention, there is provided a rectangular bottle having an offset spout for use as a container for motor oil and other related liquids. The rectangular bottle of the present invention, in its overall concept, comprises a hollow body including a front wall, back wall, right side wall, left side wall and bottom; a tubular spout through which the bottle may be filled and emptied, the spout being centrally oriented between the front and back wall and offset from the left side wall toward the right side wall; and a tapered section interposed between and connecting the body section and the spout, whereby the front wall, back wall, right side wall and left side wall slope toward and merge into the spout.

More preferably, the rectangular bottle of the present invention has an exterior length to width ratio of between about 1:0.5 to about 1:0.6, the centerline of the tubular spout is offset from the left side wall toward the right side wall between about 75% to about 80% of the length of the bottle, and the front wall slopes at an angle of between about 60° to about 70°, the back wall slopes at a supplementary angle of between about 120° to about 110°, the right side wall slopes at an angle of between about 100° to about 110°, and the left side wall slopes at an angle of about 25°, from the horizontal toward the spout.

The rectangular bottle of the present invention overcomes many of the shortcomings of the prior art by providing a plastic bottle for motor oil and the like fluids which has a high shelf-space utilization, good container integrity, shelf and warehouse life, equal or better topload strength than current plastic rectangular bottles, and further minimizes or eliminates "glug" and premature spillage problems. Most importantly, however, the rectangular bottle of the present invention is designed to be stacked and shipped on a standard 40 in.×48 in. GMA pallet, the design standard of the grocery industry.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
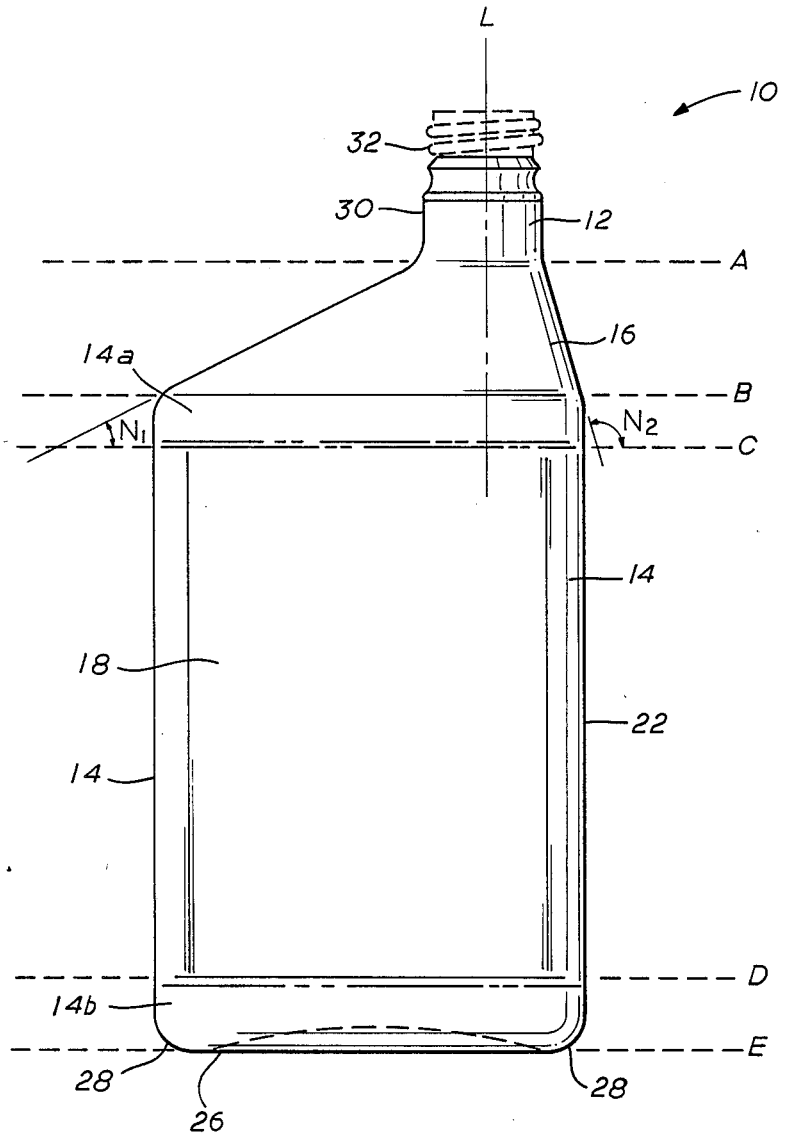
FIG. 1 is a front elevational view of a rectangular bottle of the present invention.

Referring to the drawings in more detail, particularly to FIGS. 1–4, there is illustrated a rectangular bottle 10 in accordance with the present invention. Bottle 10 has an offset tubular spout 12 through which bottle 10 may be filled and emptied, is particularly adapted for containing motor oil and other related liquids for commercial shelf display and sale and distribution in retail and wholesale outlets, and is specifically designed to be stacked and shipped efficiently on a standard 40 in.×48 in. GMA pallet.

Throughout this detailed discussion, a specific embodiment (hereinafter referred to as the "Specific Embodiment") of a bottle designed to hold about 32 fl. oz. (one quart) of motor oil, with an overflow capacity of about 35±0.5 fl. oz., will be utilized to specifically illustrate a preferred embodiment of the invention. The Specific Embodiment, as with the other embodiments in accordance with the present invention, is particularly adapted for efficient stacking on a standard 48 in.×40 in. GMA pallet (FIGS. 5–7), thereby maximizing the amount of product capable of being transported on a standard shipping pallet while minimizing the risk of container damage.

Figure 2:
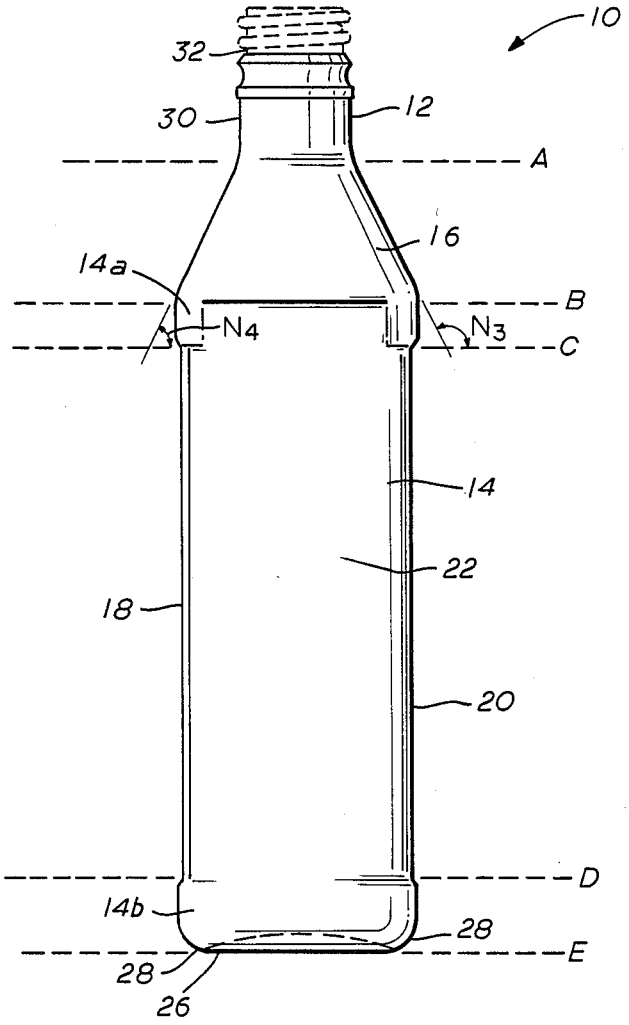
FIG. 2 is a right side elevational view of the bottle of FIG. 1.

Referring now to FIGS. 1 and 2, there is depicted rectangular bottle 10 which generally comprises tubular spout 12 (above line A), a hollow body 14 (between lines B and E) and a tapered section 16 (between lines A and B) interposed between and connecting spout 12 and hollow body 14.

Body 14 is hollow and generally rectangular in shape, and is provided as that portion of bottle 10 which, when bottle 10 is in the vertical position as depicted, holds the product (motor oil). Body 14 generally comprises a front wall 18, a back wall 20 (FIG. 2), a right side wall 22, a left side wall 24 and a bottom 26. Directional designations are in reference to bottle 10 as viewed in FIG. 1 for the purposes of this description. It should be clear, however, that turning or rotating bottle 10 may reverse the references as designated above.

Figure 3:
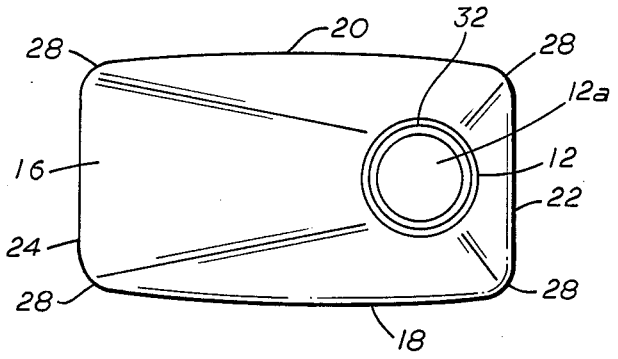
FIG. 3 is a top view of the bottle of FIG. 1.
Figure 4:
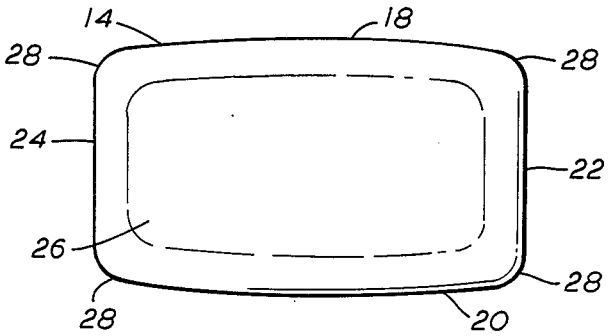
FIG. 4 is a bottom view of the bottle of FIG. 1.

As can be seen from FIGS. 3 and 4, walls 18 and 20 are substantially parallel and depicted as slightly arcuate, and walls 22 and 24 are substantially parallel and depicted as generally flat. When bottle 10 is filled with product, walls 18, 20, 22 and 24 will have a tendency to bulge slightly due to the internal forces exerted by the product as a result of its weight, vapor pressure and other related forces. Walls 18 and 20, being wider than walls 22 and 24, will tend to bulge slightly more. By constructing walls 18 and 20 slightly arcuate, the stresses on walls 18 and 20 from the product within bottle 10 will be decreased. It should be noted, however, that any of walls 18, 20, 22 and/or 24 may be constructed flat or slightly arcuate, and this should not be considered a limitation on the present invention.

As also can be seen from FIGS. 3 and 4, the corners 28 connecting walls 18, 20, 22 and 24 and bottom 26 are preferably rounded. Plastic bottles such as those of the present invention are generally manufactured by a blow-molding process. It is well known in the art that most blow-molded articles perform better with rounded, slanted and tapered surfaces. During the blow molding process wall thickness can vary from side panels to corners. Square corners may turn out thin and weak, and flat heavy side walls may turn out thick and distorted. It is, for this reason, preferred that corners 28 of bottle 10 are rounded and also that at least walls 18 and 20 are slightly arcuate; however, again these features should not be considered restrictive of the present invention.

Referring to FIGS. 1, 2 and 4, bottom 26 is also depicted as slightly arcuate, arching upwardly toward the interior of bottle 10 above the base (line E) thereof. Again, due to advantages in relation to the blow-molding process, bottom 26 is preferably arched. The upward arch is also provided so that, as bottom 26 is caused to flatten out by both internal pressures from the weight of the product and external pressures from stacking of the bottles one on top of the other, bottom 26 will not bulge and will, therefore, provide a stable base (i.e., no "rocker bottom" from bottom wall 26 bulging) for bottle 10.

In the preferred embodiment, hollow body 14 of bottle 10 preferably has an exterior length (between substantially parallel walls 22 and 24) to width (between substantially parallel walls 18 and 20) ratio of between about 1:0.5 to about 1:0.6, more preferably from about 1:0.53 to about 1:0.56. The height of hollow body 14 (between lines B and E) will vary depending upon the desired fluid capactity of bottle 10 in relation to the actual length and width thereof. It is well within the capability of one skilled in the art to calculate the height given the length and width dimensions and/or dimensional ratios and the desired fluid capacity of hollow body 14 of bottle 10.

For example, in the Specific Embodiment the exterior length to width ratio is about 1:0.54, with a length of about 4.3 in. by a width of about 2.3 in. Taking into account an average wall thickness of about 0.1 in. (this may vary greatly as detailed below), the height of body section 14 will be about 6.2 in. The tolerance of such measurements is preferably within about ±0.1 in.

As can best be seen from FIG. 2, the upper portion (between lines B and C) and lower portion (between lines D and E) of front and back walls 18 and 20, respectively, are provided with extended width shoulders **14*a* and 14*b*, respectively. The extended width of shoulders 14*a* and 14*b* serves at least two purposes. First, it provides a frame for labelling (not shown) which will be placed upon front wall 18 and back wall 20 for the ultimate distribution and sale of the product placed within bottle 10. Also, as previously mentioned, when bottle 10 is filled with product, walls 18 and 20 will tend to bulge slightly. Because of this bulge, labelling placed upon walls 18 and 20 may rub against adjacent bottles, damaging the labelling. Shoulder 14***a* above, and shoulder 14*b* below, this labelling will prevent the rubbing and potential damage by spacing apart the adjacent bottles. The extended width of shoulders 14*a* and 14*b*, however, should be kept to a minimum to minimize the open space between bottles when placed side-by-side, thereby providing more efficient space utilization by allowing more bottles to be packaged and/or displayed in a limited space.

It is preferred, therefore, that the extended width of shoulders 14*a* and 14*b* add no more than about 5% to the width of hollow body 14. In the Specific Embodiment, shoulders 14*a* and 14*b* extend the width of hollow body 14 about 0.1 in. (about 0.05 in. on each side) to a total width of about 2.4 in.

Spout 12 is integrally formed as a part of bottle 10. Spout 12 is a hollow, open tube which readily allows passage of the product contained within hollow body 14 through a port 12*a* (FIG. 3). As can be seen from FIGS. 1 and 3, spout 12 is offset along the length of bottle 10 away from left side wall 24 toward right side wall 22, but centrally oriented on the width thereof between front wall 18 and back wall 20. More preferably, the centerline L of spout 12 is offset from left side wall 24 toward right side wall 22 from between about 75% to about 80%, more preferably between about 77% to about 78%, of the length of bottle 10. In the Specific Embodiment, centerline L of spout 12 is offset about 3.3 in. from left side wall 24 toward right side wall 22. This construction is provided so that when spout 12 is rotated in the direction of left side wall 24 to pour the contents out of bottle 10, the "glug" which usually occurs when pouring the contents of standard bottles is minimized or virtually eliminated. The placement of spout 12 also is an important factor in the improved top-load strength of bottle 10.

Spout 12 preferably has an outer diameter at the neck ring 30 of about one-half the depth of hollow body 14. In the Specific Embodiment, spout 12 has an outer diameter at neck ring 30 of about 1.2 in. Spout 12 may be provided with threads 32 or other means onto which a screw cap (not shown) may be threadably engaged or other sealing means otherwise mounted to seal bottle 10.

Tapered section 16, as previously indicated, is interposed between and connects spout 12 and hollow body 14. Starting at line B, walls 18, 20, 22 and 24 are angled inwardly from hollow body 14 to merge into spout 12. In the preferred embodiment, left side wall 24 slopes at an angle N1 of about 25° from the horizontal (also the Specific Embodiment); right side wall 22 slopes at an angle N2 of between about 100° to about 110°, more preferably between about 104° to about 106°, from the horizontal (also the Specific Embodiment); front wall 18 slopes at an angle N4 of between about 60° to about 70°, more preferably between about 64° to about 66°, from the horizontal (also the Specific Embodiment); and back wall 20 slopes at an angle N3, supplementary to angle N4, of between about 120° to about 110°, more preferably between about 114° to about 116°, from the horizontal (also the Specific Embodiment), toward spout 12. The tolerance of these angles is preferably within about ±1°.

Bottle 10 is constructed of a plastic or similar material suitable for manufacture by blow-molding such as, for example, a typical blow-molding grade of high density polyethylene. Bottle 10 may be fabricated by any one of a number of well known molding techniques, such as, for example, blow molding or any other method capable of shaping the chosen plastic into the desired shape. Bottle 10 is preferably manufactured by extrusion blow molding with a programmed finish. The programmed finish allows the thickness of the walls of bottle 10 to be varied as desired to move material from a stronger point to a weaker point which may exist in the structure of bottle 10. The process of extrusion blow molding with a programmed finish is well known in the art.

Bottle 10, as previously described, is designed to be filled to between about 85% to about 95%, more preferably to between about 90% to about 93%, of its total (overflow) capacity. This prevents splashing and leaking of the contents of bottle 10 when it is being filled and sealed, and further prevents premature spillage of the contents when they are being poured out of the bottle. In the Specific Embodiment, as previously mentioned, bottle 10 is designed to hold 32 fl. oz. (one quart) with an overflow capacity of about 35±0.5 fl. oz.

Figure 5:
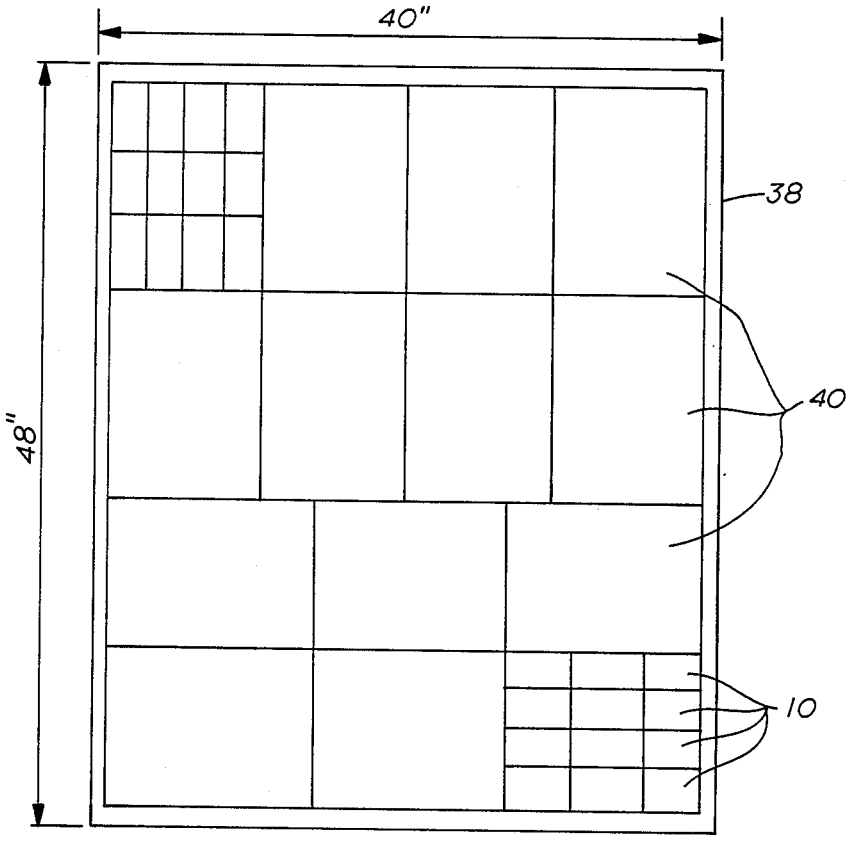
FIG. 5 is a top view of a preferred stacking pattern of a quart size bottle in accordance with the present invention on a standard 40 in.×48 in. GMA pallet.
Figure 6:
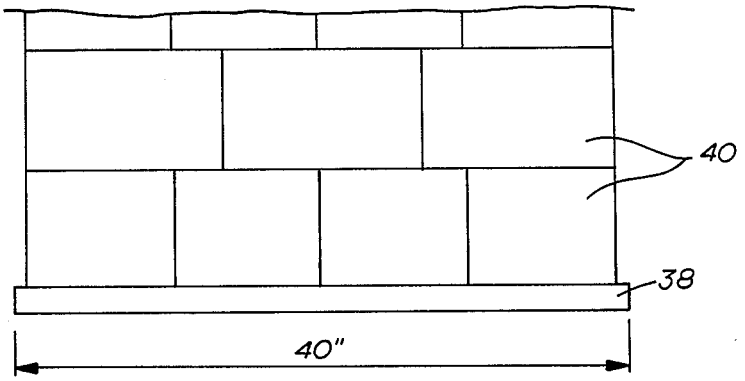
FIG. 6 is a frontal view of FIG. 5.
Figure 7:
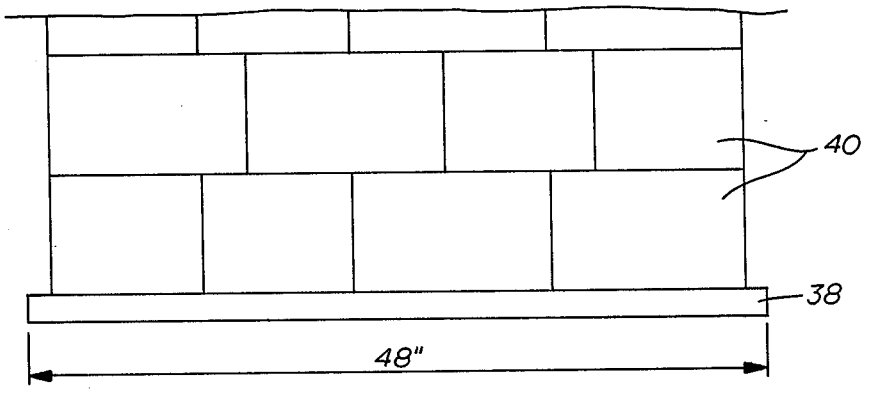
FIG. 7 is a side view of FIG. 5.

Depicted in FIG. 5 is the preferred stacking arrangement on a standard 40 in.×48 in. GMA pallet 38 of a quart size bottle in accordance with the present invention, i.e., the Specific Embodiment. Bottles 10 are preferably packaged in cases 40 of 3 across by 4 deep, or 12 bottles per case. Cases 40 are then stacked in two rows of 4 across followed by two rows of three across, a total of fourteen (14) cases 40 and one-hundred and sixty-eight (168) bottles 10 per tier on pallet 38. As shown in FIGS. 6 and 7, a plurality of tiers may be stacked on a single pallet. The Specific Embodiment is designed to be stacked seven (7) tiers high, making the pallet content 98 cases or 1176 bottles 10.

As indicated by FIGS. 5–7, the entire surface of pallet 38 is not utilized. Bottle 10 is designed so that, when properly stacked on pallet 38 (as depicted in FIGS. 5–7), only between about 95% to about 97% of the surface area of pallet 38 is covered to allow for less than perfect stacking. If the entire surface of pallet 38 were to be utilized, less than perfect stacking would result in overhang which, as previously mentioned, is to be strictly avoided. Because of the time and care required for perfect stacking, it is preferred that a small portion of the surface of pallet 38 be left uncovered.

Many modifications and variations besides the embodiments specifically mentioned may be made in the techniques and structures described herein and depicted in the accompanying drawings without departing substantially from the concept of the present invention. Accordingly, it should be clearly understood that the form of the invention described and illustrated herein is exemplary only, and is not intended as a limitation on the scope thereof.

I claim:

1. A substantially rectangular bottle for motor oil and like fluids designed to be stacked and shipped on a standard 40 in.×48 in. GMA pallet without overhang, comprising:

a hollow body including a front wall, back wall, right side wall, left side wall and bottom, said front wall and said back wall are substantially parallel, and said right side wall and said left side wall are substantially parallel, said hollow body having an exterior length, between said right side wall and said left side wall, to exterior width, between said front wall and back wall, ratio of from about 1:0.53 to about 1:0.56;

a tubular spout through which said bottle may be filled and emptied, said spout being centrally oriented between said front and back walls of said bottle, the centerline of said spout being offset from said left side wall toward said right side wall between about 75% to about 80% of said exterior length of said hollow body; and a tapered section interposed between and connecting said hollow body and said spout, whereby said front wall, back wall, right side wall and left side wall slope toward and merge into said spout, said front wall sloping at an angle of between about 60° to about 70°, said back wall sloping at a supplementary angle of between about 120° to about 110°, said right side wall sloping at an angle of between about 100° to about 110°, and said left side wall sloping at an angle of about 25°, from the horizontal toward said spout.

2. The rectangular bottle of claim 1, wherein an upper portion and a lower portion of said front and back walls are provided with an extended width shoulder.

3. The rectangular bottle of claim 1, wherein said centerline of said spout is offset from said left side wall toward said right side wall between about 77% to about 78% of said length of said bottle.

4. The rectangular bottle of claim 1, wherein said front wall slopes at an angle of between about 64° to about 66° toward said spout.

5. The rectangular bottle of claim 1, wherein said back wall slopes at a supplementary angle of between about 114° to about 116° toward said spout.

6. The rectangular bottle of claim 1, wherein said right side wall slopes at an angle of between about 104° to about 106° toward said spout.

7. The rectangular bottle of claim 1, wherein said exterior length is about 4.3 inches with a tolerance of about ±0.1 inch.

8. The rectangular bottle of claim 1, wherein said exterior width is about 2.3 inches with a tolerance of about ±0.1 inch.

9. The rectangular bottle of claim 2, wherein said extended width shoulder extends said exterior width less than about 5%.

10. The rectangular bottle of claim 9, wherein said extended width shoulder extends said exterior width about 0.1 inch.

11. The rectangular bottle of claim 1, wherein said bottle has a design capacity of about 32 fluid ounces with an overflow capacity of about 35 fluid ounces.

12. A substantially rectangular bottle for motor oil and like fluids designed to be stacked and shipped on a standard 40 in.×48 in. GMA pallet without overhang, comprising:

a hollow body including a front wall, back wall, right side wall, left side wall and bottom, said front wall and said back wall are substantially parallel, and said right side wall and said left side wall are substantially parallel, said hollow body having an exterior length, between said right side wall and said left side wall, of about 4.3 inches and an exterior width, between said front wall and back wall, of about 2.3 inches;

a tubular spout through which said bottle may be filled and emptied, said spout being centrally oriented between said front and back walls of said bottle, the centerline of said spout being offset from said left side wall toward said right side wall between about 75% to about 80% of said exterior length of said hollow body; and a tapered section interposed between and connecting said hollow body and said spout, whereby said front wall, back wall, right side wall and left side wall slope toward and merge into said spout, said front wall sloping at an angle of between about 60° to about 70°, said back wall sloping at a supplementary angle of between about 120° to about 110°, said right side wall sloping at an angle of between about 100° to about 110°, and said left side wall sloping at an angle of about 25°, from the horizontal toward said spout.

13. The rectangular bottle of claim 12, wherein an upper portion and a lower portion of said front and back walls are provided with an extended width shoulder.

14. The rectangular bottle of claim 12, wherein said centerline of said spout is offset from said left side wall toward said right side wall between about 77% to about 78% of said length of said bottle.

15. The rectangular bottle of claim 12, wherein said front wall slopes at an angle of between about 64° to about 66° toward said spout.

16. The rectangular bottle of claim 12, wherein said back wall slopes at a supplementary angle of between about 114° to about 116° toward said spout.

17. The rectangular bottle of claim 12, wherein said right side wall slopes at an angle of between about 104° to about 106° toward said spout.

18. The rectangular bottle of claim 13, wherein said extended width shoulder extends said exterior width less than about 5%.

19. The rectangular bottle of claim 18, wherein said extended width shoulder extends said exterior width about 0.1 inch.

* * * * *